United States Patent [19]

van Donk

[11] 4,007,762

[45] Feb. 15, 1977

[54] SELVAGE FORMING DEVICE FOR A WEAVING LOOM

[75] Inventor: Cornelis van Donk, Mortel, Netherlands

[73] Assignee: Ruti-Te Strake B.V., Deurne, Netherlands

[22] Filed: Dec. 24, 1975

[21] Appl. No.: 644,021

[30] Foreign Application Priority Data

Mar. 17, 1975 Netherlands ..... 7503167

[52] U.S. Cl. ..... 139/54

[51] Int. Cl.[2] ..... D03C 11/00

[58] Field of Search ..... 139/48–54, 139/430

[56] References Cited

UNITED STATES PATENTS

| | | | |
|---|---|---|---|
| 584,576 | 6/1897 | Crutchlow | 139/54 |
| 2,300,281 | 10/1942 | Barbotto | 139/54 |
| 3,741,256 | 6/1973 | Wesseler | 139/54 |

FOREIGN PATENTS OR APPLICATIONS

| | | | |
|---|---|---|---|
| 116,434 | 12/1900 | Germany | 139/54 |
| 5,561 | 1883 | United Kingdom | 139/54 |
| 18,715 | 1892 | United Kingdom | 139/54 |

*Primary Examiner*—James Kee Chi
*Attorney, Agent, or Firm*—Marshall & Yeasting

[57] ABSTRACT

The selvage forming device comprises a frame adapted to be connected to a heald of a loom and to guide at least one warp thread. Two superimposed members are rockably mounted in the frame, and an actuating arm is secured to one member for rocking said member, the members being hinged together so that rocking of one member causes the other member to rock in the opposite sense. Each member carries one of a cooperating pair of needles for guiding binding threads, the rocking motion of the members being such as to cause scissors motion of the pair of needles in a plane transverse to the wrap threads. The frame is provided with a plurality of vertical wires under tension for guiding the warp threads.

3 Claims, 2 Drawing Figures

SELVAGE FORMING DEVICE FOR A WEAVING LOOM

BACKGROUND OF THE INVENTION

This invention relates to a selvage forming device for a weaving loom, said device comprising a frame adapted to be connected to a heald of the weaving loom and adapted to guide one or more warp threads, at least two needles being mounted in said frame and extending substantially in a plane perpendicular to the plane of the fabric for guiding binding threads to be interlaced with said warp threads and the weft threads, said needles being adapted to reciprocate in the weft direction one in counterphase with respect to the other and in synchronism with the heald shaft movement.

Devices of this type are known e.g. from German patent 1,814,269 or U.S. Pat. No. 3,741,256 and British patent No. 794,515.

In the device according to the German patent each pair of co-operating guiding needles is constituted by a fork which is mounted for a rocking movement around a shaft extending between the fork legs perpendicular to the fabric. The frame comprises two hollow tube sections in which the drive shafts for the needle forks are journalled, said tube sections being connected by an intermediate piece provided with a guiding slot for the outer warp threads. A drawback of this known device is that the fibres or fluffs which are released or produced during the up and down movement of the warp and binding threads due to abrasion along the guiding surface tend to block the frame and thereby unfavourably affect the operation of the device.

The device according to the British patent No. 794,515 does not have this drawback. The latter, however, has the disadvantage that it takes a relatively large space, which — as seen in the direction of the warp threads — covers a plurality of healds.

SUMMARY OF THE INVENTION

The invention aims at providing a device of the type referred to hereinbefore, which does not have the disadvantages of the known devices.

In accordance with the present invention the frame comprises two rocking pieces adapted to be positioned one below the other in a plane perpendicular to that of the warp threads, each piece carrying a needle of a co-operating pair of needles, in which one of the rocking pieces is secured to an actuating arm projecting outwardly in the said vertical plane, the rocking pieces co-operating such that a movement imparted by the lever to the rocking piece secured thereto involves a corresponding movement of the other rocking piece in the opposite direction, the frame being further provided with one or more pairs of wires adapted to be kept taut for guiding the warp thread(s) therebetween.

The device according to the invention permits a very compact structure. It is even possible to keep the frame of the device, as seen in the warp direction, within the thickness of a weaving heald of conventional construction. The guiding wires (which may be made of metal) for the warp threads contribute to an efficient and safe operation since blocking by accumulation of fluffs is practically excluded.

In a preferred embodiment a leaf spring extends between upper and lower fixed points of the frame, both rocking pieces being secured to said spring with some mutual spacing. The fixed points thereby replace conventional pivot shafts due to which the reliability is further increased.

According to a further feature of the invention the frame comprises two sections each having the form of a flat hook adapted to be hooked around the upper and lower edge respectively of a heald, at least one of the hook-shaped frame sections having a box construction to accommodate the rocking pieces, the frame sections being connected together by the guiding wires for the warp threads.

DESCRIPTION OF THE PREFERRED EMBODIMENT

Figure 1:
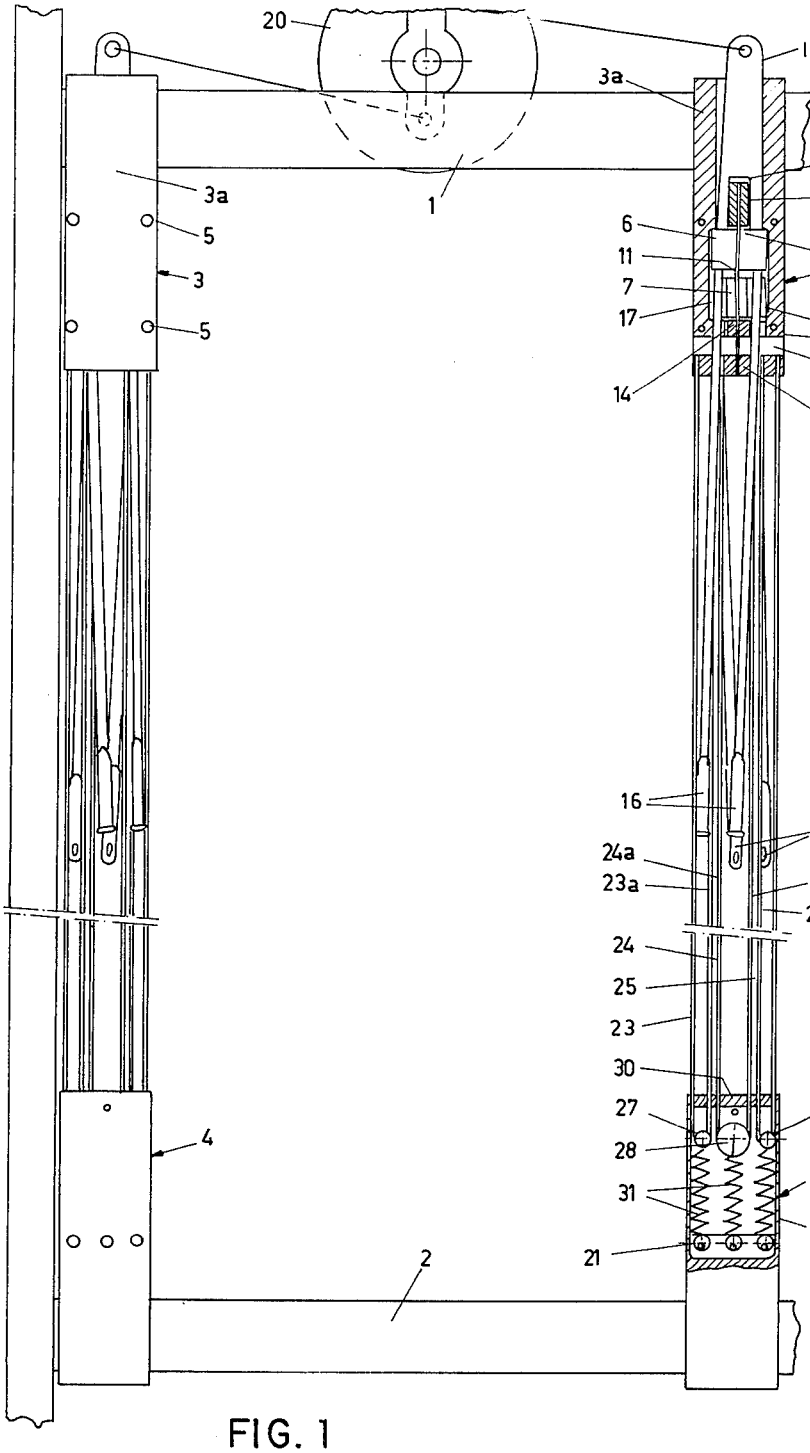
FIG. 1 is a schematic view of a weaving heald on which two devices according to the invention are mounted, one of which is shown in elevation and the other in section along to a plane parallel to that of the heald.
Figure 2:
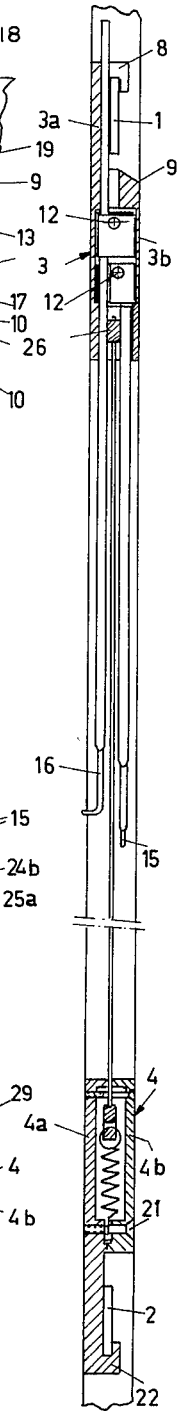
FIG. 2 is a section of the device according to the invention along to a vertical plane perpendicular to that of the heald to which it is connected.

The drawing shows the upper and lower edges 1 and 2 of a weaving heald of a construction known per se. The device according to the invention secured thereto comprises upper and lower frame sections 3 and 4 respectively.

The upper frame section 3 comprises two parts **3*a* and 3*b* which are removably connected together as by screws 5. They form together a housing in which the rocking pieces indicated at 6 and 7 are accommodated one above the other. The part 3*a* projects upwardly beyond the part 3*a* and is shaped at its upper end as a hook 8 by means of which the section 3 may be suspended from the upper edge 1 of the heald. The space which houses the rocking pieces 6 and 7 is delimited at the upper end by a wall 9 and at the lower end by a wall 10. A leaf spring 11 extends between said walls 9 and 10 and is inserted at its upper and lower ends in corresponding slits in the walls 9 and 10 respectively. The rocking pieces 6 and 7 are secured to the portion of the leaf spring 11 extending between the walls 9 and 10. For this purpose the rocking pieces have a slit located in the central longitudinal plane perpendicular to the plane of the weaving heald, the pieces being secured to the leaf spring 11 by means of a screw or other locking means 12.**

As shown in the drawing there is a certain space between the rocking pieces 6 and 7 which allows them to pivot around the points 13 and 14.

Two needles 15 are secured to the lower rocking piece 7 and extend downwardly through wide apertures in the lower end wall 10. Two needles 16 are also secured to the upper rocking piece 6 and extend downwardly through apertures 17 in the lower rocking piece 7 and through apertures in the end wall 10. Each needle 15 forms one pair with one of the needles 16.

The upper rocking piece 6 is connected to an arm 18 which has a recess 19 to accommodate the end wall 9 so that the arm 18 may extend upwardly and laterally relative to the upper end wall 9. The part of the actuating arm 18 projecting upwardly beyond the hook 8 may be coupled to a suitable control mechanism which is schematically indicated at 20 in the drawing. The lower frame section 4 likewise comprises two parts **4*a* and 4*b* which are releasably connected together by screws 21. The part 4*a* extends downwardly beyond the part 4*b*** and is shaped at its lower end as a hook 22 which may be engaged around the lower edge 2 of the heald. Both frame sections 3 and 4 are connected together and thereby kept to their operational relationship to the heald by means of a plurality of metallic wires 23, 24 and 25. Each of said wires is bent into a loop which is secured at its ends in the anchoring blocks indicated at 26 and is guided at its bend along a small pulley 27, 28 or 29 respectively, accommodated in the space within the lower frame section 4. The runs of the wires 23, 24 and 25 extend through suitable apertures in the lower end wall 10 of the upper frame section 3 and through suitable apertures in the upper end wall 30 of the lower frame section 4 respectively. Both anchoring blocks 26 are held between both parts 3*a* and 3*b* of the upper frame section 3.

In the lower frame section 4 the connecting screws 21 function at the same time as fixed anchoring points of three springs 31 which at their other ends are each in engagement with one of the pulleys 27, 28, 29. The springs 31 therefore keep the wires 23, 24 and 25 taut and permit a quick mounting of the complete device on the associated weaving heald.

In the embodiment shown the runs 23*a*, 24*a* and 24*b*, 25*a* of the wires form two guides for a warp thread. The guiding runs 23*a*, 24*a* co-operate with the pair of guiding needles 15, 16 as shown at the left in the drawing, whereas the guiding runs 24*b*, 25*a* co-operate with the pair of guiding needles 15, 16 situated to the right.

It will be evident that with the reciprocating movement of the upper end of the actuating arm 18 the needles 15, 16 of each pair of needles carry out a scissor-like motion in the plane of the weaving heald and thereby interlace binding threads threaded through said needles in a manner known per se with the associated outer warp thread(s) and the weft yarn. For the types of interlacings which may be realized in this manner reference may be made to the above-mentioned literature.

I claim:

1. A selvage forming device comprising a frame adapted to be connected to a heald of a loom and to guide at least one warp thread, wherein the improvement comprises two superimposed members rockably mounted in the frame, and an actuating arm secured to one member for rocking said member, the members being hinged together so that rocking of one member causes the other member to rock in the opposite sense, each member carrying one of a cooperating pair of needles for guiding binding threads, the rocking motion of the members being such as to cause scissors motion of the pair of needles in a plane transverse to the warp threads, and the frame being provided with a plurality of vertical wires under tension for guiding the warp threads.

2. A device according to claim 1, characterized in that a leaf spring extends between upper and lower fixed points of the frame, both rocking members being secured to said spring with some mutual spacing.

3. A device according to claim 1, characterized in that the frame comprises two sections each having the form of a flat hook adapted to be hooked around the upper and lower edge respectively of a heald, at least one of the hook-shaped frame sections having a box construction to accommodate the rocking members, and the frame sections being connected together by the guiding wires for the warp thread.

* * * * *